US010093439B2

(12) United States Patent
Lachenmeier et al.

(10) Patent No.: US 10,093,439 B2
(45) Date of Patent: Oct. 9, 2018

(54) GRIPPER

(71) Applicant: Signode Industrial Group LLC, Glenview, IL (US)

(72) Inventors: Per Lachenmeier, Sonderborg (DK); Karl Magnus Rasztar, Sonderborg (DK)

(73) Assignee: Signode Industrial Group LLC, Glenview, IL (US)

( * ) Notice: Subject to any disclaimer, the term of this patent is extended or adjusted under 35 U.S.C. 154(b) by 19 days.

(21) Appl. No.: 15/707,617

(22) Filed: Sep. 18, 2017

(65) Prior Publication Data

US 2018/0065766 A1 Mar. 8, 2018

Related U.S. Application Data

(63) Continuation of application No. 13/980,136, filed as application No. PCT/US2012/021646 on Jan. 18, 2012, now Pat. No. 9,764,867.

(30) Foreign Application Priority Data

Jan. 18, 2011 (DE) ..... 10 2011 000 205

(51) Int. Cl.
*B65B 9/14* (2006.01)
*B65B 9/10* (2006.01)
(Continued)

(52) U.S. Cl.
CPC ..... *B65B 9/14* (2013.01); *B65B 9/10* (2013.01); *B65B 9/13* (2013.01); *B65B 9/135* (2013.01); *B65B 9/18* (2013.01)

(58) Field of Classification Search
CPC ..... B65B 39/10; B65B 39/13; B65B 39/135; B65B 39/14; B65B 39/18
(Continued)

(56) References Cited

U.S. PATENT DOCUMENTS 2,711,803 A 6/1955 Hurst et al.
2,745,688 A 5/1956 Farrington et al.
(Continued)

FOREIGN PATENT DOCUMENTS

CN 101830292 9/2010
DE 2256753 5/1974
(Continued)

OTHER PUBLICATIONS

Office Action corresponding to DE102011000205.7, dated Apr. 23, 2013.
(Continued)

*Primary Examiner* — Hemant M Desai
*Assistant Examiner* — Eduardo R Ferrero
(74) *Attorney, Agent, or Firm* — Neal, Gerber & Eisenberg LLP

(57) ABSTRACT

The present invention concerns a device and method for reefing a portion of tubular film, the reefing device having at least one reefing finger and at least one drive unit. The drive unit has advancing means, which, for reefing the portion of tubular film, is brought into operative connection with the reefing finger at least at the height of a point of engagement, while enclosing the portion of tubular film, and moves the portion of tubular film in relation to the reefing finger. The device according to the invention and the method according to the invention are distinguished in particular in that the position of the at least one point of engagement can be changed along the reefing finger as reefing progresses or the position of the point of engagement on the reefing finger is changed.

20 Claims, 11 Drawing Sheets

Figure 6:
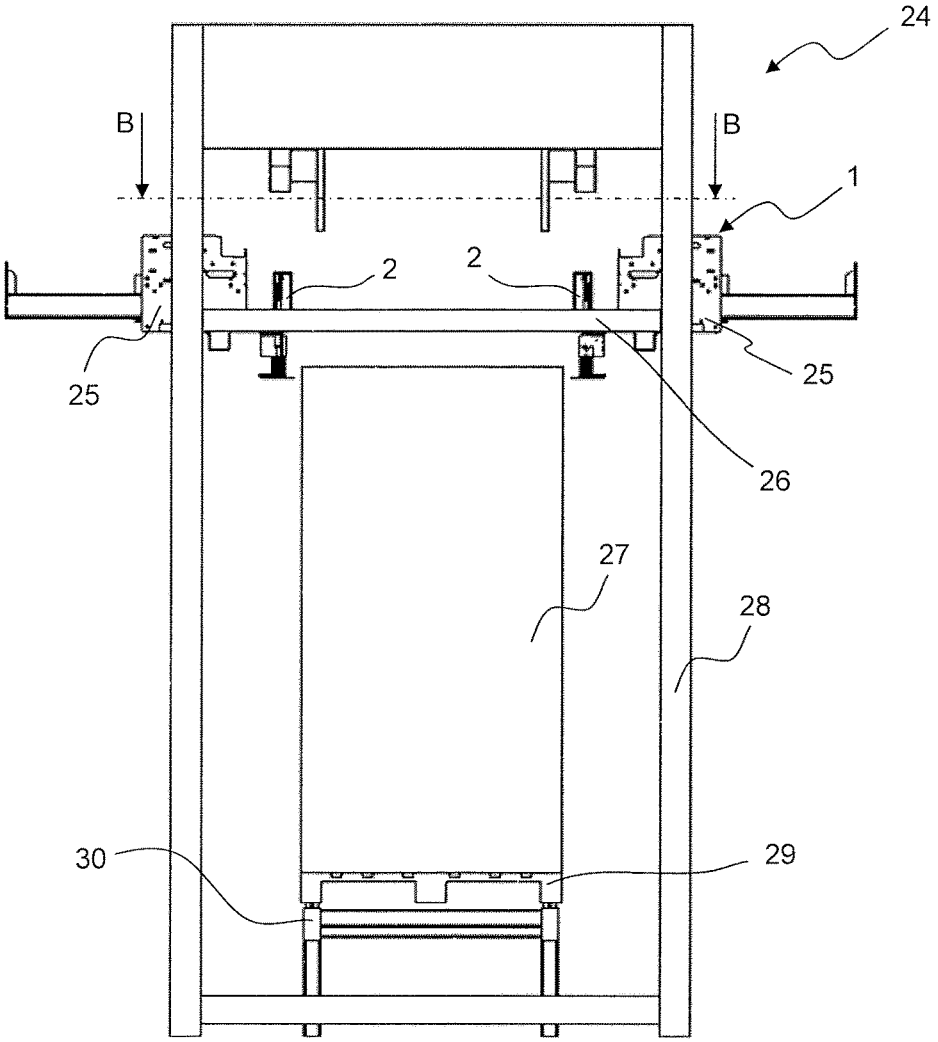

(51) Int. Cl.
*B65B 9/13* (2006.01)
*B65B 9/18* (2006.01)

(58) Field of Classification Search
USPC ..... 53/459, 441, 556, 567
See application file for complete search history.

(56) References Cited

U.S. PATENT DOCUMENTS

| | | | |
|---|---|---|---|
| 2,758,898 | A | 8/1956 | Kobsch |
| 2,797,634 | A | 7/1957 | Rueckert |
| 2,942,797 | A | 6/1960 | Lorenz et al. |
| 3,016,869 | A | 1/1962 | Anderson et al. |
| 3,190,457 | A | 6/1965 | Linden |
| 3,278,059 | A | 10/1966 | Ridgeway et al. |
| 3,436,046 | A | 4/1969 | Valeska |
| 3,507,137 | A | 4/1970 | Taleff et al. |
| 3,626,654 | A | 12/1971 | Hoffler et al. |
| 3,679,244 | A | 7/1972 | Reddy |
| 3,852,937 | A | 12/1974 | Bitsura |
| 3,902,303 | A | 9/1975 | King |
| 3,944,045 | A | 3/1976 | Higgins |
| 4,063,401 | A | 12/1977 | Higgins |
| 4,067,174 | A | 1/1978 | Goldstein |
| 4,204,377 | A | 5/1980 | Lancaster et al. |
| 4,235,062 | A | 11/1980 | Lancaster, III et al. |
| 4,317,322 | A | 3/1982 | Lancaster et al. |
| 4,473,990 | A | 10/1984 | Thimon |
| 4,587,796 | A | 5/1986 | Haloila |
| 4,588,142 | A | 5/1986 | Malzacher |
| 4,619,193 | A | 10/1986 | Crew |
| 4,631,898 | A | 12/1986 | Brambilla |
| 4,754,594 | A | 7/1988 | Lancaster |
| 4,756,143 | A | 7/1988 | Lancaster |
| 4,905,448 | A | 3/1990 | Plitt |
| 4,905,451 | A | 3/1990 | Jaconelli et al. |
| 4,914,891 | A | 4/1990 | Suolahti |
| 4,939,989 | A | 7/1990 | Zacharias |
| 5,107,657 | A | 4/1992 | Diehl et al. |
| 5,140,795 | A | 8/1992 | Steding |
| 5,154,382 | A | 10/1992 | Hoshino |
| 5,195,297 | A | 3/1993 | Lancaster et al. |
| 5,216,871 | A | 6/1993 | Hannen |
| 5,463,843 | A | 11/1995 | Sharp |
| 5,619,838 | A | 4/1997 | Kasel |
| 5,623,808 | A | 4/1997 | Franklin et al. |
| 6,032,439 | A | 3/2000 | Birkenfeld |
| 6,237,307 | B1 | 5/2001 | Zentmyer et al. |
| 6,298,636 | B1 | 10/2001 | Lachenmeier et al. |
| 6,470,654 | B1 | 10/2002 | Lachenmeier |
| 6,516,591 | B1 | 2/2003 | Lancaster, III et al. |
| 6,539,690 | B2 | 4/2003 | Alvarez |
| 6,619,872 | B2 | 9/2003 | Crorey et al. |
| 6,622,620 | B1 | 9/2003 | Byington |
| 6,865,865 | B2 | 3/2005 | Hannen et al. |
| 6,945,163 | B2 | 9/2005 | Squyres |
| 7,036,289 | B2 | 5/2006 | Suolahti |
| 7,040,076 | B2 | 5/2006 | Lachenmeier |
| 7,234,289 | B2 | 6/2007 | Hannen et al. |
| 7,325,487 | B2 | 2/2008 | Squyres |
| 7,367,740 | B2 | 5/2008 | Lazic et al. |
| 7,533,515 | B1 | 5/2009 | Koskela |
| 7,707,801 | B2 | 5/2010 | Lancaster, III |
| 7,707,802 | B2 | 5/2010 | Forrest |
| 7,908,831 | B1 | 3/2011 | Dugan |
| 7,913,476 | B2 | 3/2011 | Lachenmeier |
| 7,937,910 | B2 | 5/2011 | Jaconelli et al. |
| 7,966,790 | B2 | 6/2011 | Michels |
| 7,975,456 | B2 | 7/2011 | Lachenmeier |
| 8,141,327 | B2 | 3/2012 | Lancaster, III |
| 8,347,784 | B2 | 1/2013 | Herrmann |
| 8,453,420 | B2 | 6/2013 | Schmidt et al. |
| 8,875,480 | B2 | 11/2014 | Czok |
| 2001/0046409 | A1 | 11/2001 | Fischer |
| 2002/0033005 | A1 | 3/2002 | Lachenmeier et al. |
| 2003/0156891 | A1 | 8/2003 | Hung et al. |
| 2004/0107677 | A1 | 6/2004 | Hannen et al. |
| 2006/0005511 | A1 | 1/2006 | Suolahti et al. |
| 2006/0040085 | A1 | 2/2006 | Downs et al. |
| 2006/0285915 | A1 | 12/2006 | Dellach et al. |
| 2007/0157557 | A1 | 7/2007 | Lancaster, III |
| 2007/0163207 | A1 | 7/2007 | Chiu Chen |
| 2009/0217624 | A1 | 9/2009 | Forrest |
| 2009/0229226 | A1 | 9/2009 | Beeland et al. |
| 2009/0293425 | A1 | 12/2009 | Carter et al. |
| 2010/0018165 | A1 | 1/2010 | Kudia |
| 2010/0071317 | A1 | 3/2010 | Michels et al. |
| 2010/0163443 | A1 | 7/2010 | Storig et al. |
| 2010/0258241 | A1 | 10/2010 | Perecman |
| 2011/0258973 | A1 | 10/2011 | Czok |

FOREIGN PATENT DOCUMENTS

| | | |
|---|---|---|
| DE | 31031310 | 12/1981 |
| DE | 3918311 | 12/1989 |
| DE | 3914595 | 11/1990 |
| DE | 20101909 | 6/2002 |
| DE | 102005037916 | 5/2006 |
| DE | 102005062609 | 7/2007 |
| DE | 202007018900 | 8/2009 |
| DE | 102010037770 | 6/2012 |
| DE | 102011000205 | 7/2012 |
| DE | 102012024176 | 6/2014 |
| EP | 0 621 184 | 10/1994 |
| EP | 0 653 352 | 5/1995 |
| EP | 0 811 554 | 12/1997 |
| EP | 1 033 305 | 9/2000 |
| EP | 1 097 867 | 5/2001 |
| EP | 1 266 829 | 12/2002 |
| EP | 1266828 | 12/2002 |
| EP | 1 454 827 | 9/2004 |
| EP | 1 542 192 | 6/2005 |
| EP | 1574432 | 9/2005 |
| EP | 2060492 | 5/2009 |
| EP | 2 069 209 | 6/2009 |
| EP | 2 199 214 | 6/2010 |
| FI | 78433 | 4/1989 |
| FI | 91624 | 4/1994 |
| FR | 1 396 355 | 4/1965 |
| GB | 2 395 165 | 5/2004 |
| JP | 2002104308 | 4/2002 |
| JP | 2013154956 | 8/2013 |
| WO | 02/812065 | 2/2002 |
| WO | 2004/045952 | 6/2004 |
| WO | 2006/110596 | 10/2006 |
| WO | 2008/031449 | 3/2008 |
| WO | 2010/078915 | 6/2010 |
| WO | 2012/027705 | 3/2012 |

OTHER PUBLICATIONS

International Search Report and Written Opinion corresponding to PCT/US2012/021646 dated May 29, 2012.

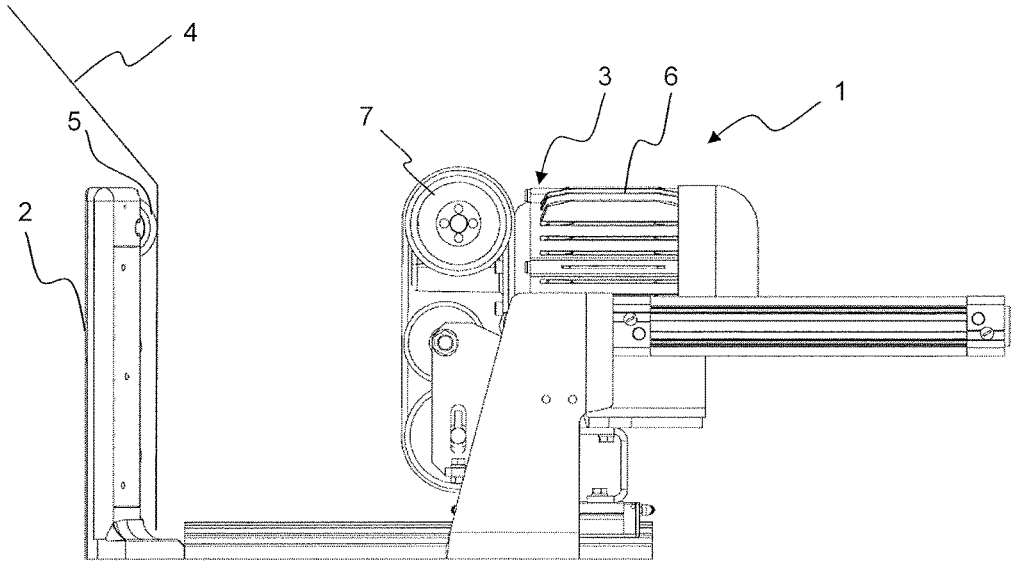
Fig. 1.1
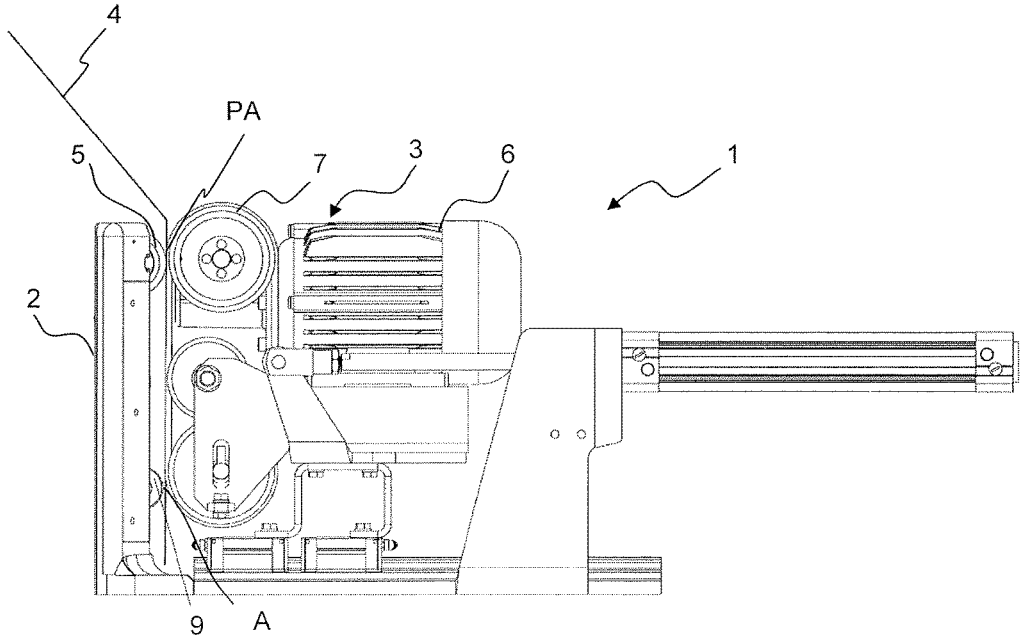
Fig. 1.2

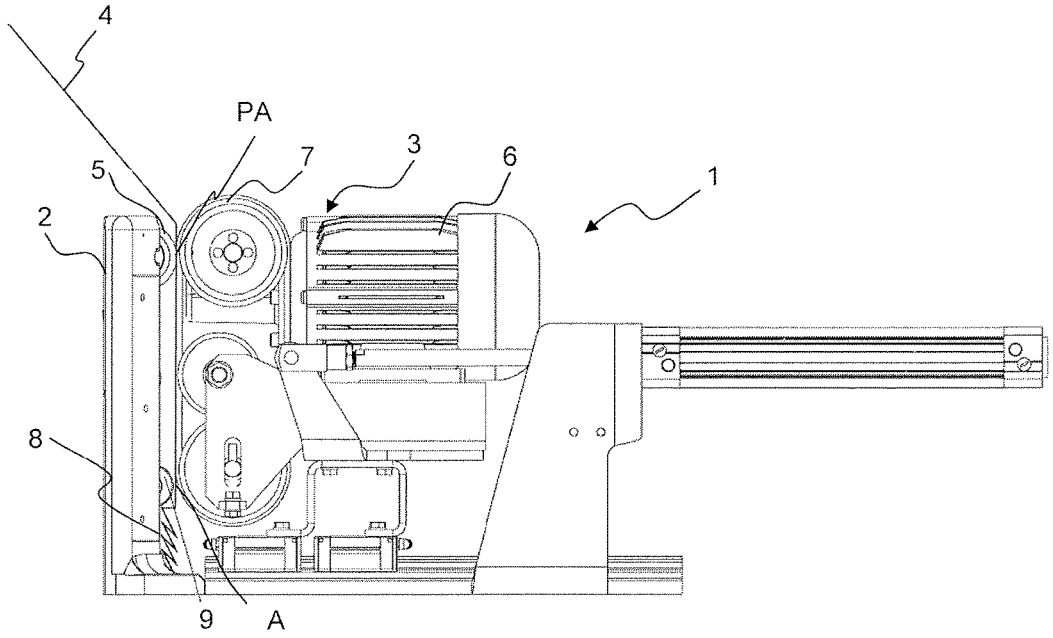
Fig. 1.3
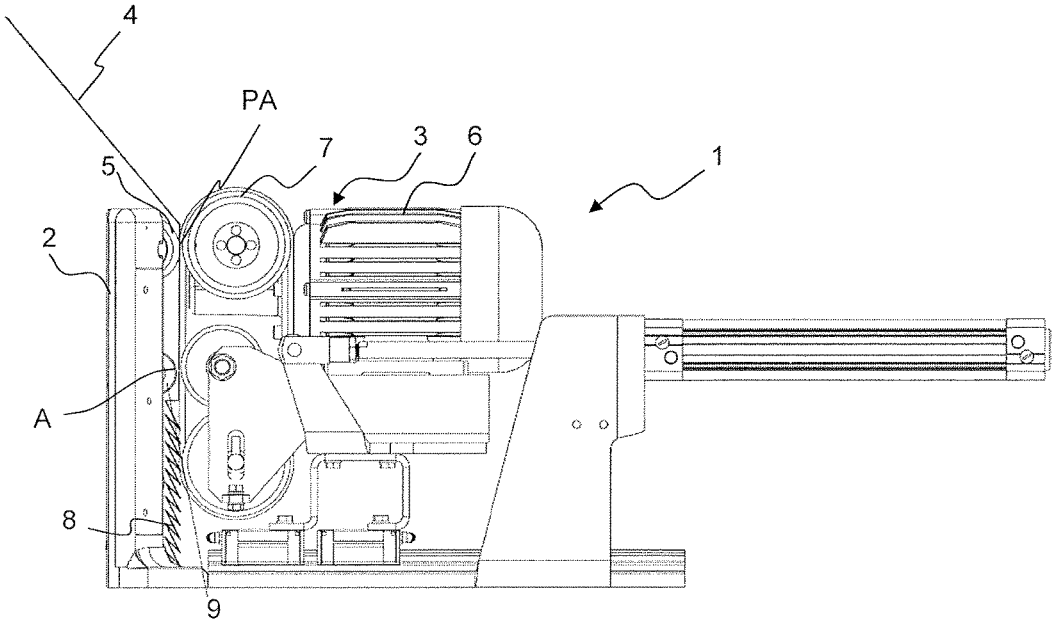
Fig. 1.4

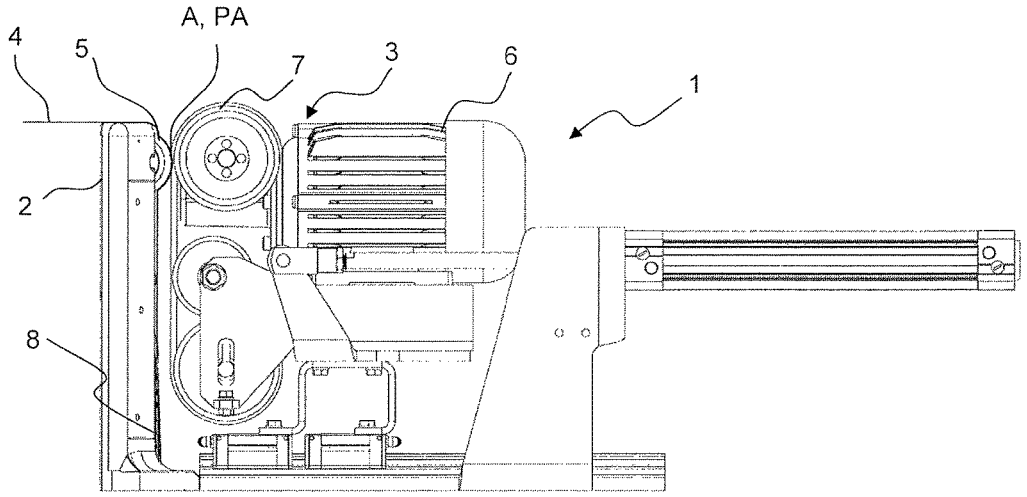
Fig. 1.5
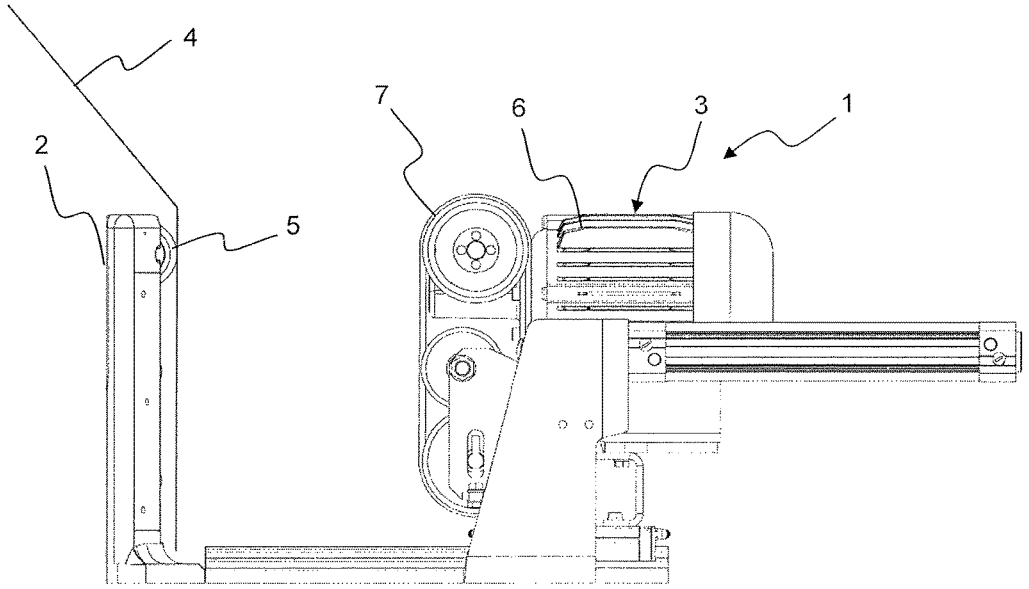
Fig. 2.1

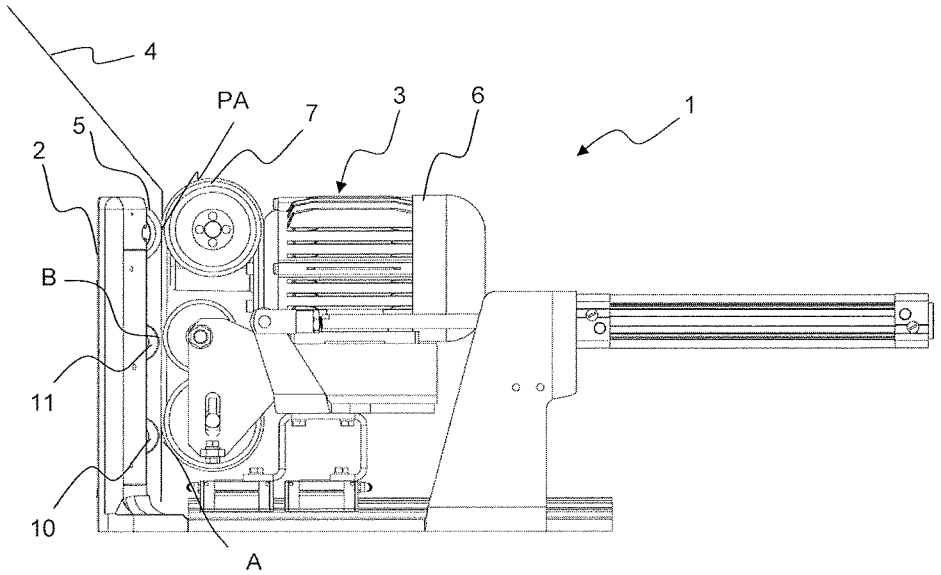
Fig. 2.2
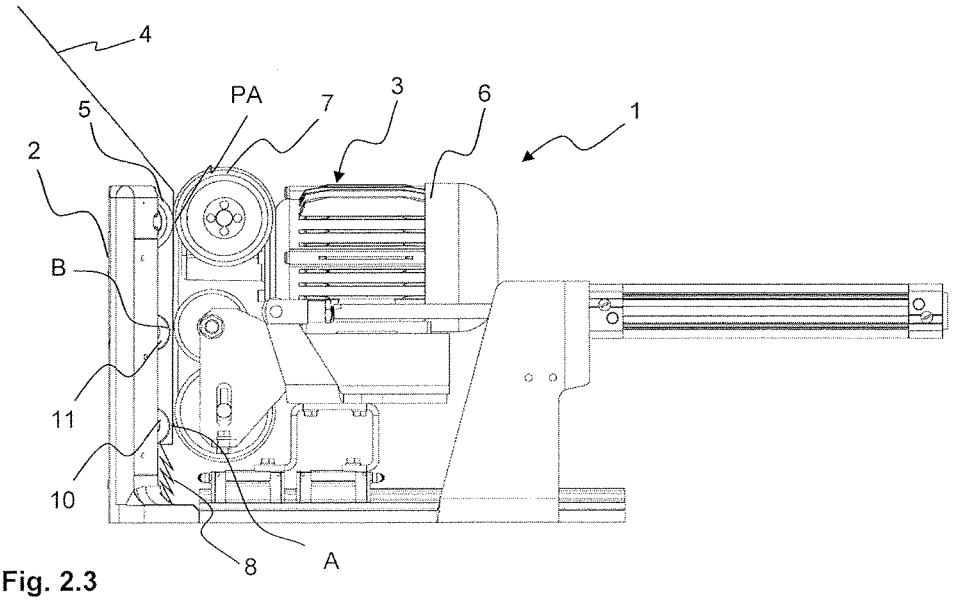
Fig. 2.3

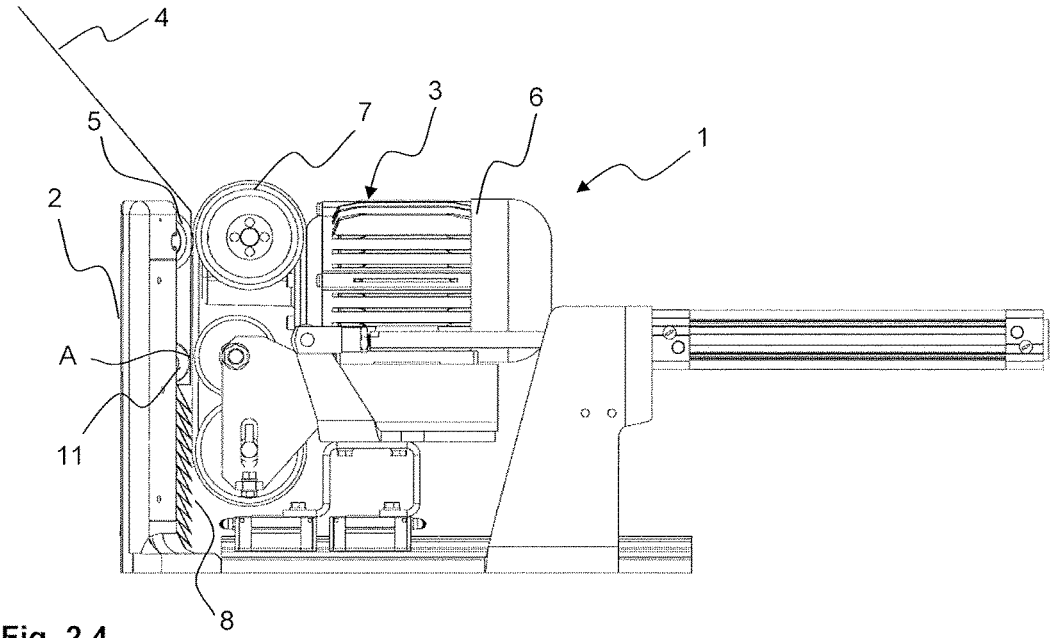
Fig. 2.4
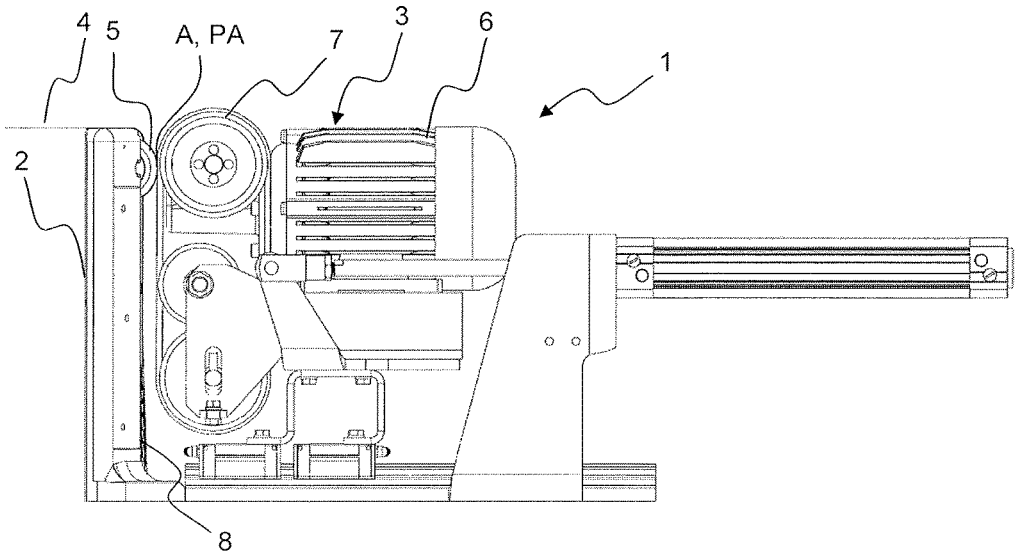
Fig. 2.5

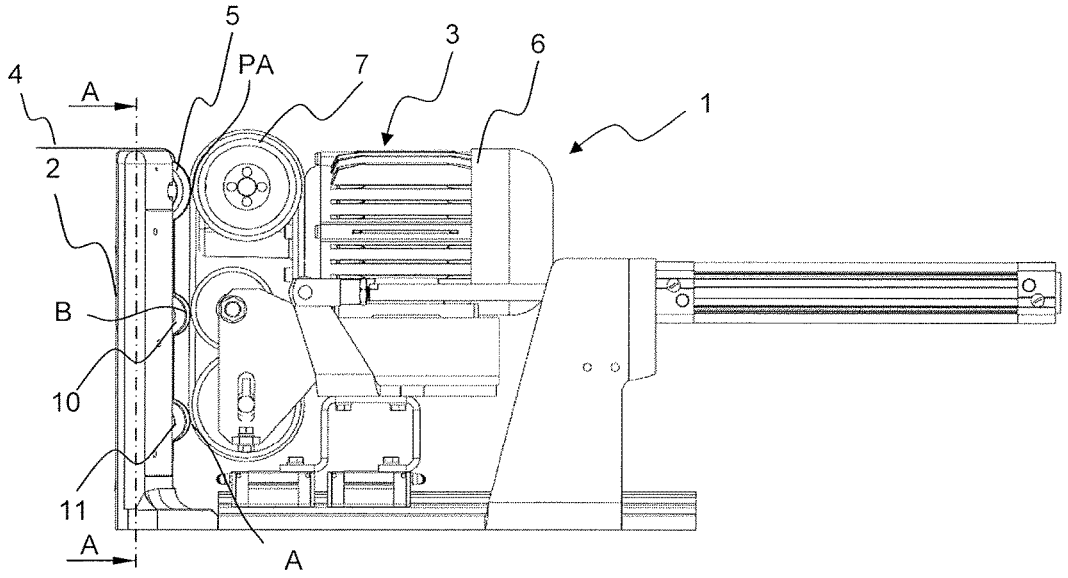
Fig. 2.6
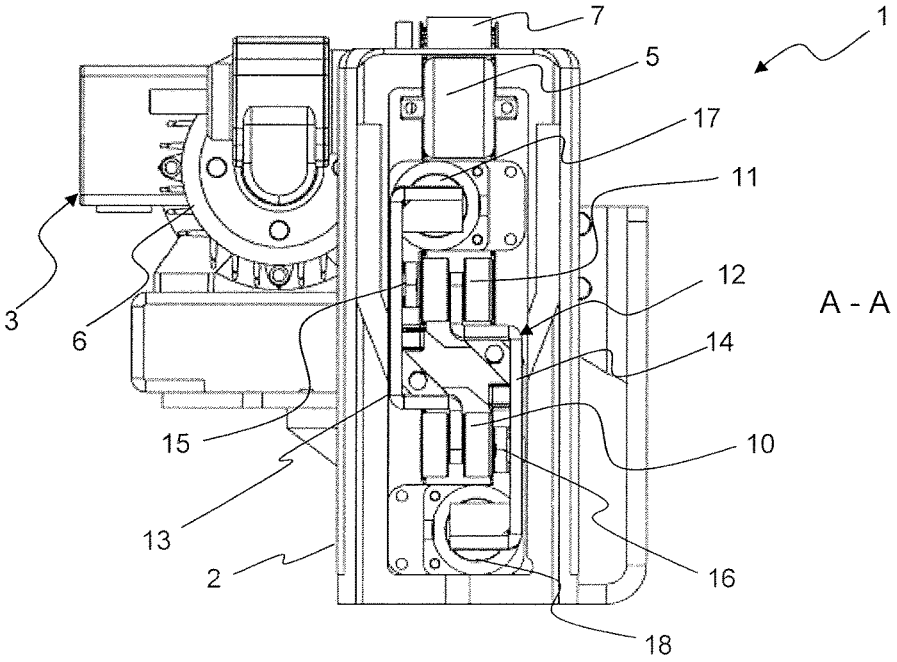
Fig. 3

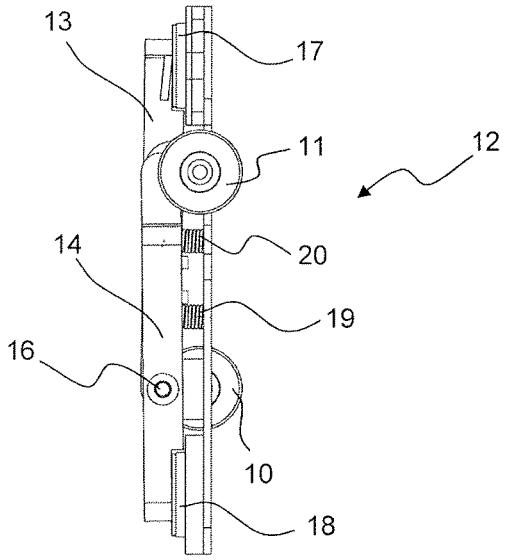
Fig. 4
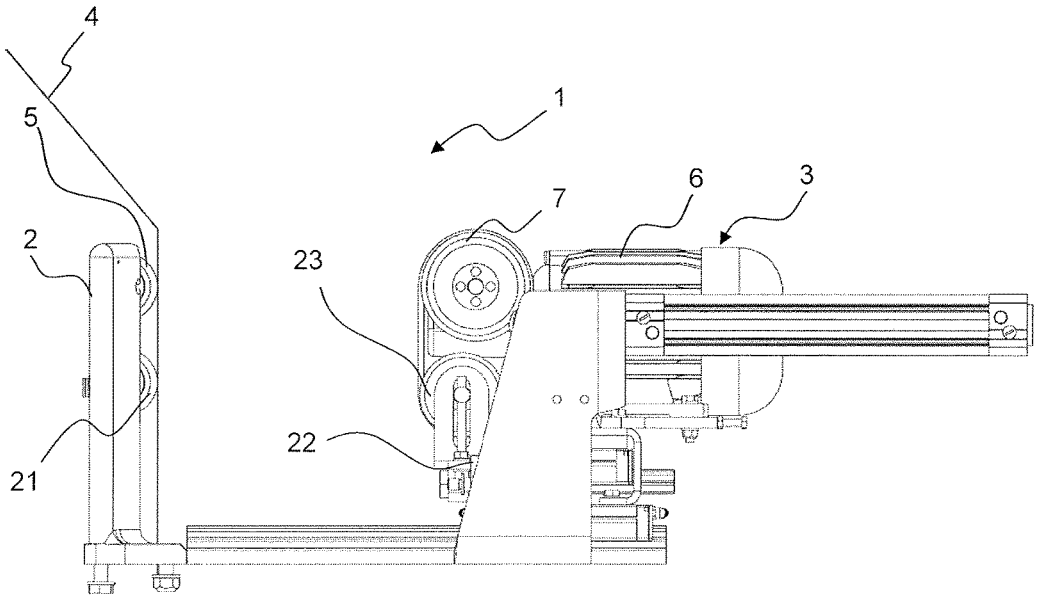
Fig. 5.1

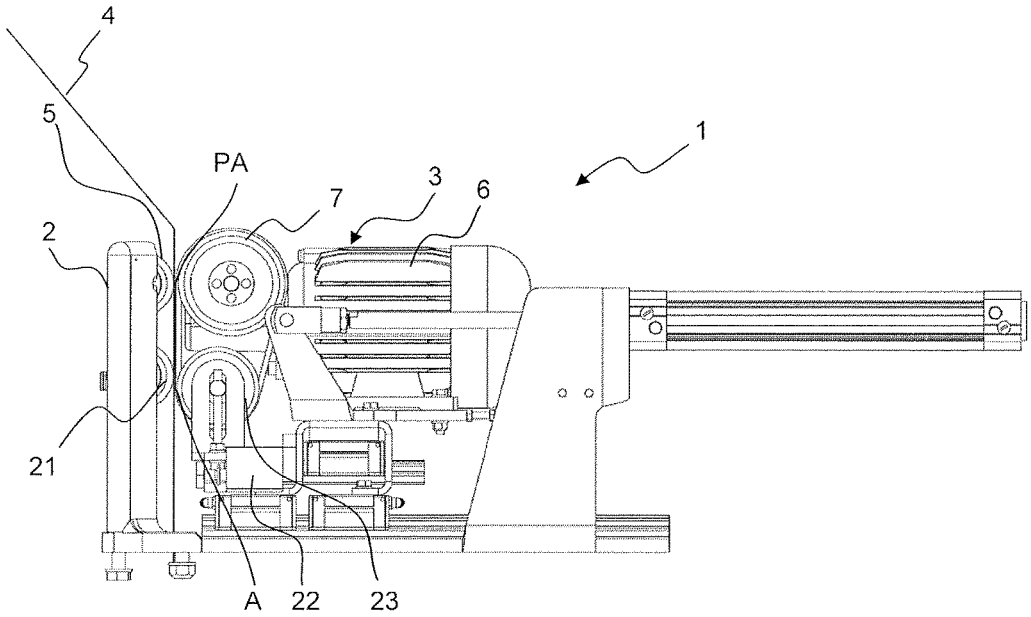
Fig. 5.2
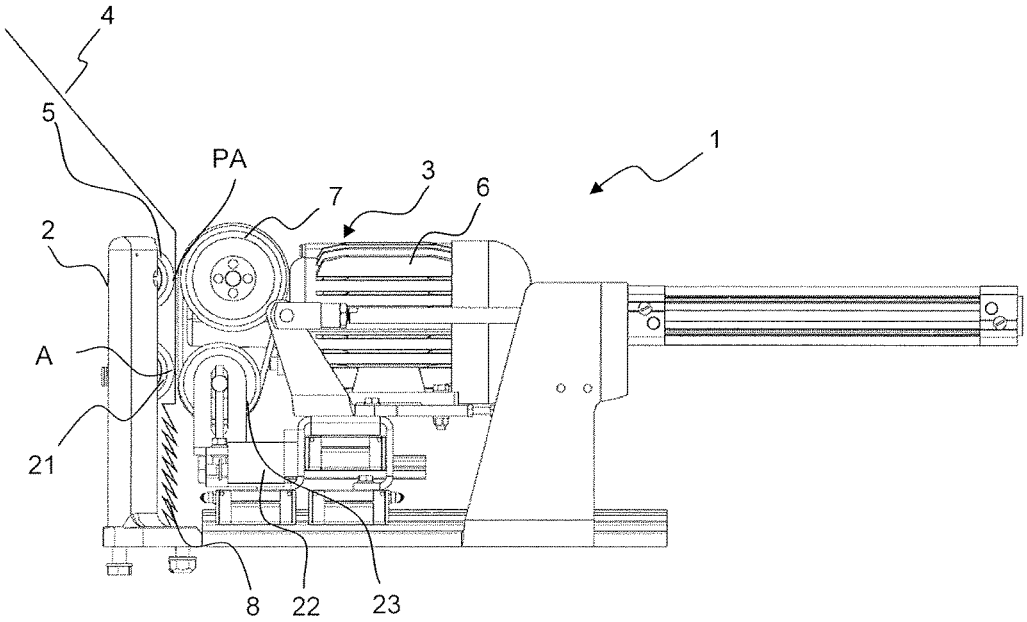
Fig. 5.3

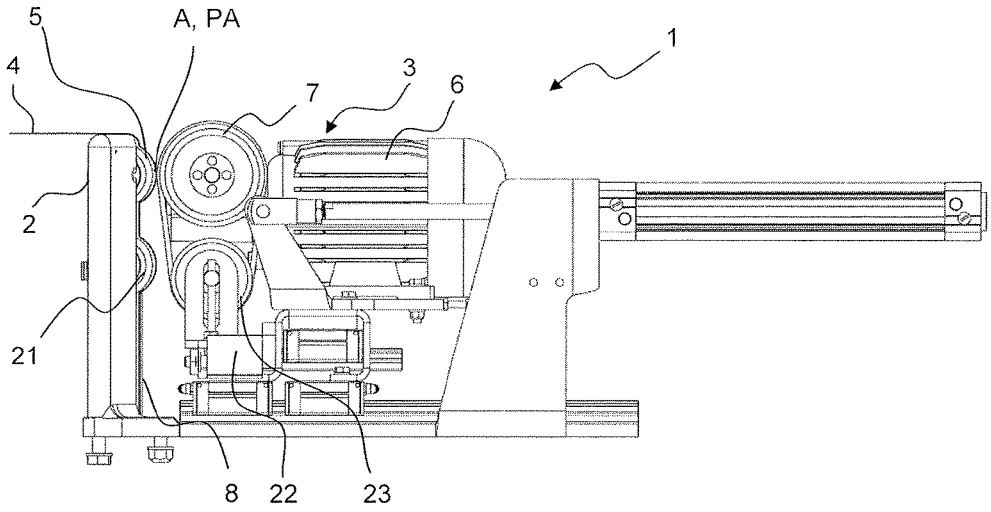
Fig. 5.4
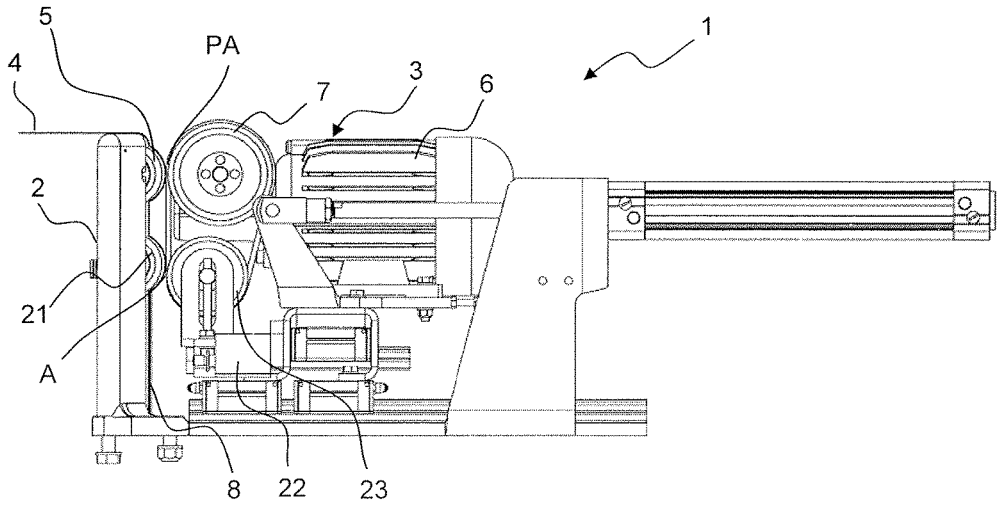
Fig. 5.5

GRIPPER

CROSS REFERENCE TO RELATED APPLICATIONS

This application is a continuation of, claims priority to and the benefit of U.S. patent application Ser. No. 13/980,136, filed on Sep. 11, 2013, now U.S. Pat. No. 9,764,867, which issued on Sep. 19, 2017, which is a National Phase of International Application No. PCT/US2012/021646, filed Jan. 18, 2012 and claims priority to and the benefit of German Patent Application No. 102011000205.7, filed on Jan. 18, 2011, the entire contents of each are incorporated by reference herein.

The present invention concerns a reefing device with at least one reefing finger and at least one drive unit, which has an advancing means, which, for reefing a portion of tubular film, is brought into operative connection with the reefing finger, at least at the height of a point of engagement, while enclosing the portion of tubular film, and moves the portion of tubular film in relation to the reefing finger. The present invention also concerns a method for reefing a portion of tubular form with a reefing device according to the invention.

Such reefing devices and methods are known per se and are used for example in hood packaging installations. These may be installations which operate on the basis of what is known as the hood stretching process or the hood shrinking process. Both processes are distinguished by the fact that a portion of a tubular film is pulled or pushed over any desired cargo, or that the cargo is introduced into the portion of tubular film by means of a lifting table. This is referred to hereafter as wrapping of cargo. The wrapping of the cargo with a portion of tubular film generally serves for the packaging and transportability of the cargo and for securing it during loading and protecting it from the effects of weather. To this extent, the portion of tubular film that is applied to the cargo may be designed not only as a hood but also, for example, as an upwardly open portion of tube in the manner of a banderole.

In the case of most hood packaging installations, the portion of tubular film is first reefed by means of a reefing device, to then be slipped over the cargo by the reefing device or by a separate drawing-over device and thereby unreefed. During the reefing, a supply of portions of tubular film laid in folds, which is also referred to hereafter as a film store, is formed at the bottom of the reefing fingers. If the reefing device is also used for the drawing over, the reefing device is moved in relation to the cargo, possibly after stretching the portion of tubular film. During this relative movement, the portion of tubular film is pulled off from the reefing fingers, also referred to as unreefed. Therefore, a film store is built up during the reefing, while the film store becomes depleted during the unreefing. To this extent, the expressions reefing, as reefing progresses, or the like, also refer to unreefing.

For the reefing, the reefing fingers are usually introduced into the opened portion of tubular film from below, or the latter is lowered onto the reefing fingers. In order then to be able to move the portion of tubular film in relation to the reefing finger and lay it in folds, reefing devices of the generic type have at least one drive unit of any desired design, with an advancing means such as for instance a motor-operated conveyor belt or a reefing roller drive.

For reefing the portion of tubular film, the drive unit is brought into operative connection with the reefing finger, at least at the height of a point of engagement, while enclosing the portion of tubular film. This may take place, for example, by pressing the drive device or the advancing means against the reefing finger at a single point. Then, by means of the drive unit or the advancing means, the portion of tubular film can be moved in relation to the reefing fingers under a certain pressing pressure and pushed onto or pulled off again from said fingers. There is therefore generally a frictional connection between the drive unit or the advancing means and the portion of tube. At least one point of engagement should be understood as meaning at least one location which comprises at least one point or a number of points, for example in the manner of a line or surface area.

In order to achieve optimum wrapping of the cargo, uniform formation of folds that are as parallel as possible is advantageous. They should be produced during the reefing of the portion of film, and consequently during the building up of the film store. Non-uniform formation of folds has the consequence during the reefing of the portion of tubular film that the corresponding region of the portion of tubular film undergoes increased loading, since there is an abrupt pulling apart of the tubular film. It is not uncommon for this to lead to the portion of tubular film being pulled until thin, or even tearing, and consequently to reduced quality of the wrapping of the cargo.

The invention is therefore based on the object of improving the reefing of a portion of tubular film, so that altogether improved quality of the wrapping of the cargo is obtained.

The object is achieved by an device according to claim 1 and by a method according to claim 14. Advantageous developments of the invention are described in the subclaims.

The reefing device according the invention differs from the reefing device described at the beginning in that the position of the at least one point of engagement can be changed along the reefing finger as reefing progresses. Unlike in the case of the previously known devices, the position of the point of engagement is adapted during the reefing to the extent of the film store. Consequently, a substantially constant distance can be maintained between the film store and the point of engagement, thereby bringing about always the same film formation during the reefing, and optimum unfolding during the unreefing of the portion of tubular film.

If the film is acted upon at the height of different points of engagement, it is expedient if, with a number of points of engagement, the position of the lowermost point of engagement can be changed along the reefing finger as reefing progresses. The lowermost point of engagement should be understood here as meaning the point of engagement which is closest to the film store, or the bottom of the reefing finger. It is consequently possible for only the lowermost point of engagement to be changed in its position along the longitudinal axis of the reefing finger, while another point of engagement remains unchanged in its position. This has the advantage that the drive means can act on the portion of tubular film at a number of places, and consequently securely, with a relatively low structural expenditure. Nevertheless, the positive effect of uniform fold formation during the reefing and uniform unfolding during the unreefing is obtained on account of the distance from the film store being kept as constant as possible.

In a development, at least one opposing roller is fastened to the reefing finger in such a way that the opposing roller can be brought into operative connection with the advancing means during the reefing, while enclosing the portion of tubular film, and defines the point of engagement. The opposing roller reduces the friction between the reefing finger and the tubular film.

It is of advantage here of the at least one opposing roller is fastened to the reefing finger in such a way that the position of the opposing roller on the reefing finger can be changed as reefing progresses. Thus, in the case of a fixed advancing means, the point of engagement can be changed by changing the position of the opposing roller on the reefing finger.

Expediently, the at least one opposing roller is fastened to the reefing finger in such a way that it is longitudinally and/or transversely displaceable and/or pivotable with respect to the reefing finger. A movement longitudinally with respect to the reefing finger can be understood here as meaning a movement along the longitudinal axis of the reefing finger. In this connection, a movement transverse to the reefing finger describes a movement transverse to the longitudinal axis of the reefing finger. This is of advantage since the movement of the opposing roller is accompanied by a corresponding change in position of the point of engagement. Accordingly, on the one hand a longitudinal displacement or corresponding pivoting of the opposing roller can define a point of engagement that is permanent but variable in its position with respect to the reefing finger. On the other hand, the point of engagement can be created and removed again as required by a transverse displacement or corresponding pivoting of the opposing roller. It is also conceivable that a point of engagement is first created for example by a transverse movement of the opposing roller and is then changed in its position with respect to the reefing finger by a longitudinal movement of the opposing roller, before the point of engagement is removed again by a renewed transverse movement.

Advantageously, a plurality of opposing rollers are arranged on the reefing finger in such a way that different opposing rollers can be brought into operative connection with the advancing means as reefing progresses. Consequently, a plurality of points of engagement can be created, it being possible for the position of the lowermost point of engagement to be changed by the successive setting up and successive removal of the operative connections of individual opposing rollers to the advancing means.

In a development, at least one fixedly mounted opposing roller may be arranged at the upper end of the reefing finger. This opposing roller serves firstly for securely guiding the portion of film over the upper end of the reefing finger. It may, however, also be used for creating a point of engagement in the sense of the invention, that is whenever the drive unit can be brought into operative connection with it. In this connection, the upper end of the reefing finger should be understood as meaning the end which is generally furthest away from the film store.

Expediently, the drive unit and/or the advancing means can be at least partially changed in its/their position in relation to the reefing finger. Consequently, the position of a point of engagement can be changed by changing the position of the drive unit or the advancing means in relation to the reefing finger.

In actual fact, the advancing means may be a drive roller or a continuous belt. However, it is also conceivable that the advancing means comprises a number of drive rollers, which can, for example, also be activated asynchronously. Expediently, the surface of the advancing means is profiled or coated in such a way that an ideal coefficient of friction is obtained for the advancement or movement of the portion of tubular film.

In a development, the advancing means is pivotably and/or displaceably configured in such a way that, during the reefing, it can be brought into operative connection with the reefing finger, while enclosing the portion of tubular film, at different heights according to how much reefing has progressed. This has the advantage that the advancing means can be used to define at least one point of engagement, the position of which is changed by pivoting and/or displacing the advancing means. Consequently, the construction of the reefing finger can be kept relatively simple and does not have to be changed in comparison with conventional reefing fingers to realize the invention.

Expediently, for this purpose the advancing means can be moved together with at least one opposing roller. In an expedient way, for this purpose the advancing means is pivotably and/or displaceably configured in such a way that, during the reefing, it is in operative connection with the at least one pivotable and/or displaceable opposing roller, while enclosing the portion of tubular film, according to how much reefing has progressed, while at least the position of the lowermost point of engagement is changed by displacing and pivoting the advancing means and the opposing roller. The at least one point of engagement is therefore defined both by the at least one opposing roller and by the advancing means and may be maintained on the film the whole time during reefing, while the position of the at least one point of engagement is changed. This allows there to be a distance between the lowermost point of engagement and the film store that is largely constant and as small as possible. In this way, an optimum reefing result can be achieved.

Expediently, the advancing means is pivotably and/or displaceably configured in such a way that, during the reefing, it can be brought into operative connection with different opposing rollers, while enclosing the portion of tubular film, according to how much reefing has progressed. Consequently, the position particularly of the lowermost point of engagement can be changed intermittently, in that the advancing means is brought into operative connection with different opposing rollers one after the other.

Furthermore, the reefing device may be designed in such a way that it comprises a plurality of reefing fingers and assigned drive units, it being possible for the individual reefing finger to be individually activated by its assigned drive unit. Thus, for example, four reefing fingers may be provided, with four respectively assigned drive units, which are respectively assigned to the corners of a typical packaging unit, such as for example a pallet. In the case of this design of the reefing device, the individual reefing fingers may be operated by their drive unit in isolation and separately from one another, for example if it is desired to achieve a specific fold formation, for instance to strengthen the package to be produced. The reefing operation may also be adapted to the respective circumstances, for example a more complex form of the cargo to be wrapped. If, for instance, an asymmetrical cargo has to be wrapped, it may be advantageous to reef a greater film store on one or more reefing fingers.

As already mentioned, the object with respect to the method is achieved by a method for reefing a portion of tubular film according to claim 14. The method according to the invention is therefore distinguished in comparison with known methods by the fact that the position of the lowermost point of engagement on the reefing finger is changed as reefing progresses.

Unlike before, the position of the point of engagement is adapted during the reefing to the extent of the film store. Consequently, the distance between the film store and the point of engagement can be kept substantially constant, whereby a more uniform fold formation during the reefing and a better unfolding of the film store during the unreefing of the portion of tubular film are obtained.

Expediently, during the reefing of the portion of tubular film, the lowermost point of engagement is displaced from the lower end of the reefing finger to the upper end of the reefing finger. This provides a substantially constant and preferably minimal distance between the lowermost point of engagement and the film store, whereby a more uniform and constantly parallel formation of folds is achieved in the film store during the reefing of the portion of tubular film.

Furthermore, it is expedient if, during the unreefing of the portion of tubular film, the lowermost point of engagement is displaced from the upper end of the reefing finger to the lower end of the reefing finger. The substantially constant and smallest possible distance between the lowermost point of engagement and the film store during the unreefing has the effect that the portion of tubular film is stripped off or unfolded from the reefing finger more uniformly than before. This too prevents the portion of tubular film from becoming thin or tearing as a result of the portion of tubular film being suddenly pulled apart.

It is advantageous if the position of the lowermost point of engagement is changed by displacing and/or pivoting at least one opposing roller of the reefing finger. Thus, the movement of the at least one opposing roller can effect a corresponding change in position of the point of engagement. The longitudinal displacement or pivoting of the opposing roller may consequently define the point of engagement that is permanent but variable in its position with respect to the reefing finger, a transverse displacement or pivoting of the opposing roller creating or removing a point of engagement.

It may also be advantageous if the position of the lowermost point of engagement is changed by displacing and/or pivoting the advancing means. Thus, the advantage of the constantly maintained distance of the point of engagement from the film store can be achieved with relatively little expenditure.

Figure 7:
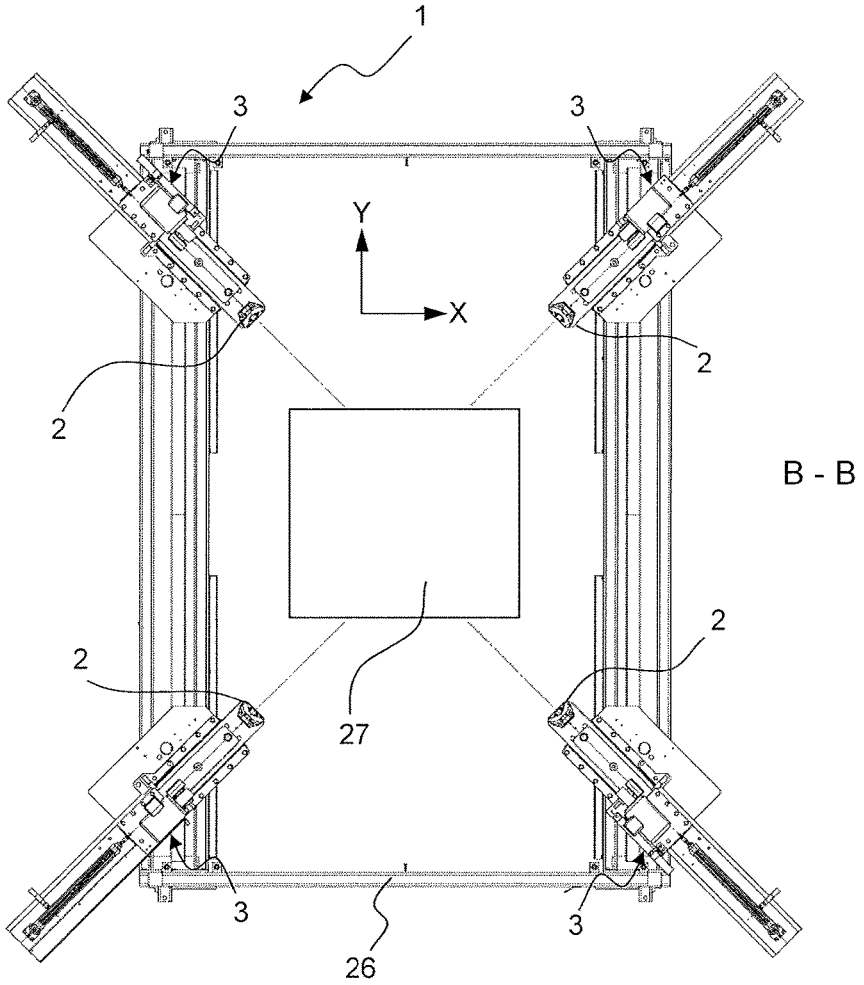

The invention is explained in more detail below on the basis of exemplary embodiments that are shown the drawings, in which schematically:

FIGS. 1.1 to 1.5 show a detail of the first exemplary embodiment of a reefing device according to the invention with an opposing roller that can be displaced transversely and longitudinally;

FIGS. 2.1 to 2.6 show a detail of a second exemplary embodiment of a reefing device according to the invention with two transversely displaceable opposing rollers;

FIG. 3 shows the section A-A through the reefing device shown in FIG. 2;

FIG. 4 a side view of the lever mechanism shown in FIG. 3;

FIGS. 5.1 to 5.5 show a detail of a third exemplary embodiment of a third reefing device with advancing means;

FIG. 6 show a side view of a hood packaging installation with a reefing device according to the invention; and FIG. 7 the section B-B through the hood packaging installation shown in FIG. 6.

Identical components are given the same designations in the text which follows and are provided with the same reference signs in the drawings.

The exemplary embodiments of a reefing device 1 according to the invention that are shown in FIGS. 1, 2 and 5 each comprise a total of four reefing fingers 2 that are arranged in the corners of a four-cornered reefing frame and can be individually activated, with in each case an assigned drive unit 3 for reefing the portion of tubular film 4. For better representation of the invention, however, only one reefing finger 2 with its assigned drive unit 3 is respectively shown in FIGS. 1, 2 and 5.

In the case of all three embodiments shown here, the respectively L-shaped reefing fingers 2 have a fixedly mounted opposing roller 5 at the upper end of the vertical member. On the horizontal members of the reefing fingers 2, a drive unit 3 is respectively displaceably arranged. Each drive unit 3 has a reefing motor 6 and an advancing means 7, the reefing motor 6 driving the advancing means 7. In the case of all three exemplary embodiments shown here, the advancing means 7 is configured as a continuous belt, although it is also conceivable that it may be just a single roller or the like. The drive units 3 and the advancing means 7 thereof can be respectively displaced over guiding rails and thus brought into operative connection with the associated reefing fingers 2.

In the case of the detail of a first exemplary embodiment of the reefing device according to the invention that is shown in FIG. 1, apart from the fixedly but rotatably attached opposing roller 5, the reefing finger 2 has a further opposing roller 9, which is displaceable transversely and longitudinally with respect to the reefing finger 2. This opposing roller may be retracted completely into the reefing finger 2, as shown in FIG. 1.1, or be extended, as shown in FIG. 1.2. The pivoted-out opposing roller 9 therefore defines the lowermost point of engagement A here.

The method according to the invention for reefing a portion of tubular film 4 according to a first embodiment is described below on the basis of FIGS. 1.1 to 1.5.

FIG. 1.1 shows the reefing device 1 in a method step in which a portion of tubular film 4 has already been pushed over the reefing finger 2 and, after that, the four reefing fingers 2 have been spread slightly apart. Consequently, the opposing roller 5 that is fixedly mounted at the upper end of the reefing finger 2 is already in contact with the inner side of the portion of tubular film 4. The drive unit 3, however, has not yet been brought into operative connection with the reefing finger 2, while enclosing the portion of tubular film 4.

As shown in FIG. 1.2, for this purpose the drive unit 3 is moved horizontally. Then a first point of engagement, referred to hereafter as permanent point of engagement PA, is created at the opposing roller 5. At the same time, the opposing roller 9 is also extended. Therefore, here too, the advancing means 7 comes into operative connection with an opposing roller arranged on the reefing finger 2 and a second, lowermost point of engagement A is created, while enclosing the portion of tubular film 4.

Subsequently, as shown in FIG. 1.3, the advancing means 7 is driven by means of the reefing motor 6, so that the portion of tubular film 4 is moved in relation to the reefing finger 2 and is consequently reefed. At the bottom of the reefing finger 2, the portion of tubular film 4 is laid down and forms the film store 8 there. As can be seen from FIG. 1.3, the film store 8 increases as the reefing increasingly progresses, until the upper end of the film store 8 almost coincides spatially with the lowermost point of engagement A.

As can be seen from FIG. 1.4, the displaceable opposing roller 9 is then displaced along the longitudinal axis of the reefing finger 2 in the direction of the upper end of the reefing finger 2, the distance between the film store 8 and the lowermost point of engagement A, defined with respect to the opposing roller 9, remaining substantially constant. As the film store 8 grows, the position of the lowermost point of engagement A is therefore likewise displaced in the direction of the upper end of the reefing finger 2. This provides consistent conditions under which the folds form and leads to a uniform formation of the folds in the film store 8.

As soon as the opposing roller 9 has been displaced along the reefing finger 2 into its maximum, i.e. uppermost, position on the reefing finger 2, the opposing roller 9 is displaced or pivoted transversely with respect to the reefing FIG. 2, as represented in FIG. 1.5, and is consequently retracted into the reefing finger 2. This removes the operative connection between the opposing roller 9 and the advancing means 7. Consequently, the fixedly mounted opposing roller 5, which is still in operative connection with the advancing means 7, while enclosing the portion of tubular film 4, defines both the permanent point of engagement PA and the lowermost point of engagement A. At the same time, the reefing operation is ended, so that there is a sufficient distance between the film store 8 and the fixedly located opposing roller 5 to smooth the folds during the unreefing of the portion of tubular film 4 before they meet the opposing roller 5.

After ending the reefing operation, firstly part of the portion of tubular film 4 is unreefed by a corresponding movement of the advancing means 7. Subsequently, the four reefing devices 1 are moved apart and the portion of tubular film 4 is thereby stretched, as is indicated in FIG. 1.5 by the unreefed part of the portion of tubular film 4 then extending horizontally with respect to the reefing finger 2.

The unreefing operation is not shown here, but proceeds substantially such that the opposing roller 9 is only extended when the unreefing operation is well advanced—that is to say when the film store 8 has been depleted to the greatest extent—and can consequently be brought into operative connection with the advancing means 7, while enclosing the portion of tubular film 4. Furthermore, during the unreefing operation, the reefing motor 6 can drive the advancing means 7 in such a way that the unreefing speed of the portion of tubular film 4 thereby produced is slower than the relative speed of the reefing frame or the reefing device 1 with respect to the cargo to be wrapped. Consequently, during the unreefing, the portion of tubular film 4 is extended or stretched along the cargo in the direction of movement of the reefing frame. In order to prevent the portion of tubular film 4 being pulled thin or torn here during the stretching, an appropriate distance between the fixedly mounted opposing roller 5 and the film store 8 is necessary—as already described—for smoothing the folds. It is thus ensured that the portion of tubular film 4 completely unfolds before it meets the opposing roller 5. This ensures great immunity from tearing during unreefing.

If, during the unreefing, a deliberate, and consequently wanted, formation of folds is to be obtained in the tubular film, the movement of the reefing frame or the reefing device 1 may be interrupted at an appropriate point. The opposing roller 9 is brought into operative connection with the advancing means 7 at the desired height on the film store 8 and the corresponding part of the film store 8 is unreefed by driving of the advancing means 7. More film is thereby applied locally to the cargo to be wrapped, in order in this way to achieve a strengthening of the packaging.

In FIG. 2, a detail of a second exemplary embodiment of the reefing device 1 according to the invention is shown. Unlike in the case of the first exemplary embodiment, arranged on the reefing finger 2 are two displaceable opposing rollers 10, 11, which however are only displaceable transversely with respect to the reefing finger 2, and a fixed opposing roller 5.

In the text which follows, the method according to the invention for reefing a portion of tubular film 4 by using the previously described second embodiment of the reefing device 1 according to the invention is explained in FIGS. 2.1 to 2.6.

In a way similar to that shown and explained in the case of the first embodiment in FIG. 1.1, first the portion of tubular film 4 is lowered onto the four reefing fingers 2. Then, as shown in FIG. 2.2, at each reefing finger 2 the assigned drive unit 3 is brought into operative connection with the reefing finger 2. A permanent point of engagement PA is thereby created in the region of the fixedly mounted opposing roller 5 and the advancing means 7. Here, the portion of tubular film 4 is acted upon permanently and in the same position with respect to the reefing finger 2 during the reefing. At the same time, the two opposing rollers 10 and 11 are extended from the reefing finger 2. Therefore, two further points of engagement A and B are created. However, as will be shown below, unlike the point of engagement PA, these points of engagement are not present throughout the entire process.

And yet, first both opposing rollers 10, 11 are extended and, as shown in FIG. 2.3, the advancing means 7 is driven by means of the reefing motor 6. Consequently, the portion of tubular film 4 is laid in folds at the bottom of the reefing finger 2 and the film store 8 is produced or increased. As soon as the upper end of the film store 8 has almost reached the opposing roller 10, and consequently almost coincides spatially with the lowermost point of engagement A, the lowermost opposing roller 10 is displaced or retracted transversely with respect to the reefing finger 2. As FIG. 2.4 reveals, the operative connection to the lower opposing roller 10 is thereby removed. Consequently, the lowermost point of engagement A is then defined by the operative connection between the opposing roller 11 and the advancing means 7, while enclosing the portion of tubular film 4. With a growing film store 8, the position of the lowermost point of engagement A is consequently displaced in the direction of the upper end of the reefing finger 2 by retraction of the opposing roller 10.

When the upper end of the film store 8 has then almost reached the opposing roller 11, the opposing roller 11 is also displaced transversely with respect to the reefing finger 2 and the operative connection in the region of the opposing roller 11 is removed. As FIG. 2.5 reveals, the fixedly mounted opposing roller 5 then defines both the permanent point of engagement PA and the lowermost point of engagement A at which the operative connection of the advancing means 7 and the reefing finger 2 exists, while enclosing the portion of tubular film 4.

During the subsequent unreefing of the portion of tubular film 4—which proceeds in principle as already described in the case of the first exemplary embodiment—the opposing rollers 10 and 11 are only extended when the progress of unreefing is well advanced. Consequently, it is only at the end of the unreefing, when the film store 8 is already depleted, that three points of engagement A, B, PA occur, as is shown in FIG. 2.6.

FIG. 3 shows the section A-A, through the reefing device 1 shown in FIG. 2, extending through the reefing finger 2. The reefing finger 2 comprises a lever mechanism 12 for pivoting the opposing rollers 10 and 11, which is arranged below the fixedly mounted opposing roller 5 within the reefing finger 2.

FIG. 4 shows the lever mechanism 12 according to the invention that is shown in FIG. 3 in a representation on its own. The lower opposing roller 10 is arranged on the reefing finger 2 pivotably about a first pivot axis 15 by means of a first lever arm 13. The upper opposing roller 11 is arranged on the reefing finger 2 pivotably about a second pivot axis 16 by means of a second lever arm 14. The length of the lever arms 13, 14 from the pivot axes 15, 16 is so great that the distance produced by the pivoting is sufficient for a complete separation of the operative connection between the opposing rollers 10 and 11 and the advancing means 7. For the pivoting, the lever arms 13, 14 are actuated by means of pneumatic cylinders 17, 18 assigned to them. Both lever arms 13, 14 each have an assigned spring 19, 20. The springs 19, 20 act on the lever arms 13, 14 in such a way that the opposing rollers 10, 11 fastened thereto are pivoted into the reefing finger 2 when the pneumatic cylinders 17, 18 do not apply any opposed operating pressure.

According to the invention, the pneumatic cylinder 17, 18 can be activated separately, in order in this way to bring about an individual pivoting of the opposing rollers 10, 11. Generally, only a relatively small cylinder stroke is necessary. In the embodiment shown here, a cylinder stroke of 5-5 mm is already sufficient to bring about a complete transverse pivoting of the opposing rollers 10, 11. In order to accommodate the lever mechanism 12 in the reefing finger 2 in a space-saving manner, the lever arms 13, 14 are correspondingly laterally bent (FIG. 3).

FIG. 5 shows a detail of a third exemplary embodiment of a reefing device 1 according to the invention, which in principle is constructed in a way similar to the two other exemplary embodiments. However, in this exemplary embodiment the reefing fingers 2 of the reefing device 1 have in addition to the opposing roller 5 fixedly mounted at the upper end of the reefing finger 2 in each case a further fixedly mounted opposing roller 21. Both opposing rollers 5, 21 can be brought into operative engagement with the advancing means 7, while enclosing the portion of tubular film 4, by moving the drive unit 3 or the advancing means 7 thereof. The drive unit 3 comprises a pneumatic cylinder 22, which for this purpose can displace a lower deflecting roller 23 of the advancing means 7 in a rail-guided manner. However, it is also conceivable that a hydraulic cylinder or the like is used instead of the pneumatic cylinder 22.

In the text which follows, the method according to the invention for reefing the portion of tubular film 4 with the third embodiment of the reefing device 1 according to the invention is explained on the basis of FIGS. 5.1 to 5.5.

In the case of the method step shown in FIG. 5.1, the portion of tubular films 4 has already been pushed over the reefing finger 2, and the four reefing fingers 2 of the reefing device 1 have been slightly spread. The two fixedly mounted opposing rollers 5, 21 of each of the reefing fingers 2 is in contact with the inner side of the portion of tubular film 4. An operative connection between the drive units 3 of the reefing fingers 2 has not yet been established.

Then, as shown in FIG. 5.2, the drive unit 3 is brought into operative connection with the respective reefing finger 2 while enclosing the portion of tubular film 4. The operative connection created between the upper opposing roller 5 and the advancing means 7, while enclosing the tubular film 4, defines a permanent point of engagement PA. The lowermost point of engagement A is created by pressing the advancing means 7, formed as a conveyor belt, against the lower opposing roller 21 of the reefing finger 2.

After that, the advancing means 7 is driven by the reefing motor 6, and the reefing operation proceeds to the state represented in FIG. 5.3. The portion of tubular film 4 is hereby moved in relation to the reefing finger 2 and laid in folds at the bottom of the reefing finger 2. The film store 8 produced increases as reefing progresses, until the upper end of the film store 8 has almost reached the opposing roller 21, as shown in FIG. 5.3.

As FIG. 5.4 reveals, a lower part of the advancing means 7, here the lower deflecting roller 23 of the conveyor belt, is then pushed away from the opposing roller 21 by actuation of the pneumatic cylinder 22. As a result, the operative connection of the lower opposing roller 21 and the advancing means 7 is removed. Consequently, only the upper opposing roller 5 is in operative connection with the drive unit 3. The reefing can then be continued, but the reefing operation is ended in such a way that a sufficient distance remains between the produced film store 8 and the fixedly mounted opposing roller 5 for smoothing the folds during the unreefing of the portion of tubular film 4. The smoothing of the folds is also possible beyond the lower opposing roller 21, since this roller is not in operative connection with the advancing means 7. As described in the case of the first two exemplary embodiments, part of the portion of tubular film 4 is then unreefed again before the four reefing fingers 2 of the reefing device 1 are moved apart, and the portion of tubular film 4 is consequently transversely extended, that is stretched. This state is shown in FIG. 5.4.

After the stretching, for the unreefing of the film store 8, at first the lower deflecting roller 23 is still kept in the moved-out position shown in FIG. 5.4. However, once the film store has then been reduced to such an extent that it no longer reaches to the lower opposing roller 21, the lower deflecting roller of the conveyor belt 7 is moved up to the opposing roller 21, as shown in FIG. 5.5. Then, the remaining film store 8 is unreefed.

In this third exemplary embodiment too, during the unreefing operation the portion of tubular film 4 can be stretched along the cargo to be wrapped by driving the advancing means 7, as described in the case of the other exemplary embodiments. Also in the case of this exemplary embodiment it is possible to apply the formation of folds specifically to the cargo to be wrapped, in order in this way to achieve a strengthening of the packaging.

FIG. 6 shows a hood packaging installation 24 operating on the basis of the stretching method, with the reefing device 1 according to the invention, the reefing device 1 comprising four reefing fingers 2 with a respectively assigned drive unit 3. The reefing fingers 2 and the assigned drive units are fastened to a one-part reefing frame 26 by fastening plates 25. Since the representation in FIG. 6 is a side view, only the reefing fingers 2 lying at the front are visible. The drive units 3 assigned to the reefing fingers 2 are concealed by the fastening plates 35. The reefing fingers 2 can be moved in the horizontal direction for the stretching of the portion of tubular film 4 (not represented). For the wrapping of the cargo 27, after the reefing operation the reefing frame 26 is moved vertically along the framework 28. As this happens, the portion of tubular film 4 is unreefed from the reefing fingers 2 and the cargo 27 is packaged. The cargo 27 is mounted on a pallet 29 and is transported into and out of the hood packaging installation 24 by means of a transporting device 30. The transporting device 30 may, as shown here, be designed such that it is raised off the floor, so that the pallet 29 can be at least partially wrapped together with the cargo 27.

FIG. 7 shows the section B-B through the hood packaging installation 24 shown in FIG. 6, all four reefing fingers 2 and drive units 3 that are arranged on the reefing frame 26 being represented. For the stretching of the reefed portion of tubular film 4, the four reefing fingers 2 are moved by the respectively assigned drive unit 3 in the diagonal direction, as is indicated by the dash-dotted lines. As a result, the reefed portion of tubular film 4 (not represented here) is stretched in the X and Y directions. In order to be able to adapt the packaging to be achieved individually to the respective cargo 27, the reefing fingers 2 and drive units 3 may also be moved individually and separately from one another.

LIST OF REFERENCE SIGNS

1 Reefing device
2 Reefing finger
3 Drive unit
4 Portion of tubular film
5 Fixedly mounted opposing roller
6 Reefing motor
7 Advancing means
8 Film store
9 Transversely and longitudinal a displaceable opposing roller
10 Transversely displaceable opposing roller
11 Transversely displaceable opposing roller
12 Lever mechanism
13 First lever arm
14 Second lever arm
15 First pivot axis
16 Second pivot axis
17 First pneumatic cylinder
18 Second pneumatic cylinder
19 Spring
20 Spring
21 Fixedly mounted opposing roller
22 Pneumatic cylinder
23 Lower deflecting roller of the advancing means
24 Hood packaging installation
25 Fastening plate
26 Reefing frame
27 Cargo
28 Framework
29 Pallet
30 Transporting device
A lowermost point of engagement
B further point of engagement
PA permanent point of engagement

The invention claimed is:

1. A method for reefing a portion of tubular film onto a reefing finger, the method comprising:

engaging the portion of tubular film with an advancing device such that the advancing device and the reefing finger hold the portion of tubular film therebetween at a first engagement point;

driving the advancing device to begin reefing the portion of tubular film onto the reefing finger;

eliminating the first engagement point between the advancing device and the reefing finger; and after or contemporaneously with eliminating the first engagement point between the advancing device and the reefing finger, stopping the driving of the advancing device to stop reefing the portion of tubular film onto the reefing finger.

2. The method of claim 1, wherein the reefing finger comprises a first roller, the advancing device comprises a second roller, and eliminating the first engagement point between the advancing device and the reefing finger comprises moving the second roller relative to the reefing finger.

3. The method of claim 2, wherein moving the second roller relative to the reefing finger comprises controlling an actuator to move the second roller relative to the reefing finger.

4. The method of claim 2, wherein engaging the portion of tubular film with the advancing device such that the advancing device and the reefing finger hold the portion of tubular film therebetween at the first engagement point further comprises engaging the portion of tubular film with the advancing device such that the advancing device and the reefing finger hold the portion of tubular film therebetween at a second engagement point.

5. The method of claim 4, wherein the reefing finger comprises a third roller, the first engagement point is between the advancing device and the first roller, and the second engagement point is between the advancing device and the third roller.

6. The method of claim 1, wherein engaging the portion of tubular film with the advancing device such that the advancing device and the reefing finger hold the portion of tubular film therebetween at the first engagement point further comprises engaging the portion of tubular film with the advancing device such that the advancing device and the reefing finger hold the portion of tubular film therebetween at a second engagement point.

7. The method of claim 6, wherein the reefing finger comprises a first roller and a second roller, the first engagement point is between the second roller and the advancing device, and eliminating the first engagement point between the advancing device and the reefing finger comprises moving the second roller relative to the reefing finger.

8. The method of claim 7, wherein moving the second roller relative to the reefing finger comprises pivoting the second roller relative to the reefing finger.

9. The method of claim 8, further comprising moving the second roller along the reefing finger and toward the first roller while driving the advancing device to reef the portion of tubular film onto the reefing finger and before eliminating the first engagement point between the advancing device and the reefing finger.

10. The method of claim 1, further comprising unreefing the portion of tubular film off of the reefing finger after reefing the portion of tubular film onto the reefing finger.

11. The method of claim 3, wherein the actuator comprises a cylinder.

12. A reefing device for reefing a portion of tubular film, the reefing device comprising: a reefing finger; an advancing device movable into operative connection with the reefing finger at a first engagement point and a second engagement point; a motor drivingly engaged to the advancing device and configured to drive the advancing device to begin reefing the portion of tubular film onto the reefing finger and thereafter stop driving the advancing device to stop reefing the portion of tubular film onto the reefing finger; and an actuator configured to move a component of one of the reefing finger and the advancing device to eliminate the first engagement point but not the second engagement point after the motor drives the advancing device to begin reefing the portion of tubular film onto the reefing finger and before or at the same time as the motor stops driving the advancing device to stop reefing the portion of tubular film onto the reefing finger.

13. The reefing device of claim 12, wherein the reefing finger comprises a first roller, the advancing device comprises a second roller, and the actuator is configured to move the second roller relative to the reefing finger to eliminate the first engagement point.

14. The reefing device of claim 13, wherein the advancing device further comprises the actuator.

15. The reefing device of claim 13, wherein the first engagement point is between the advancing device and the first roller, the reefing finger further comprises a third roller, and the second engagement point is between the advancing device and the third roller.

16. The reefing device of claim 12, wherein the reefing finger comprises a first roller and a second roller.

17. The reefing device of claim 16, wherein the first engagement point is between the advancing device and the first roller and the second engagement point is between the advancing device and the second roller.

18. The reefing device of claim 17, wherein the actuator is configured to move the first roller relative to the reefing finger to eliminate the first engagement point.

19. The reefing device of claim 18, wherein the first roller is movable along the reefing finger and toward the second roller.

20. The reefing device of claim 12, wherein the actuator comprises a cylinder.

* * * * *